United States Patent [19]

Glenn, Jr.

[11] 3,942,374

[45] Mar. 9, 1976

[54] APPARATUS FOR THE DETERMINATION OF THE QUANTITY OF OIL

[75] Inventor: James J. Glenn, Jr., Long Beach, Calif.

[73] Assignee: N L Industries, Inc., New York, N.Y.

[22] Filed: Aug. 19, 1971

[21] Appl. No.: 173,105

Related U.S. Application Data

[63] Continuation-in-part of Ser. No. 731,445, May 23, 1968, Pat. No. 3,650,148.

[52] U.S. Cl. ..... 73/155; 73/61.1 R; 73/425.4 R

[51] Int. Cl.[2] ..... E21B 47/04

[58] Field of Search ..... 73/155, 61.1 R, 425.4 R

[56] References Cited

UNITED STATES PATENTS

| | | | |
|---|---|---|---|
| 3,431,974 | 3/1969 | Buck et al. | 73/155 X |
| 3,530,711 | 9/1970 | Tocanne | 73/155 |

*Primary Examiner*—Jerry W. Myracle

[57] ABSTRACT

An oil well usually has a quantity of water admixed with the oil and it is frequently desirable to determine how much water is present. This invention provides a method and a tool which can be lowered into the oil well from the surface and whereby the relative amount of water admixed with the oil can be determined in situ at selected portions of the well through which the tool passes.

5 Claims, 22 Drawing Figures

INVENTOR.
JAMES J. GLENN, JR.

BY

Philip Subkow & Bernard Kriegel
ATTORNEYS.

INVENTOR.
JAMES J. GLENN, JR.
BY
Philip Subkow & Bernard Kriegel
ATTORNEYS.

INVENTOR.
JAMES J. GLENN, JR.
BY
Philip Subkow & Bernard Kriegel
ATTORNEYS.

INVENTOR.
JAMES J. GLENN, JR.
BY
Philip Subkow & Bernard Kriegel
ATTORNEYS.

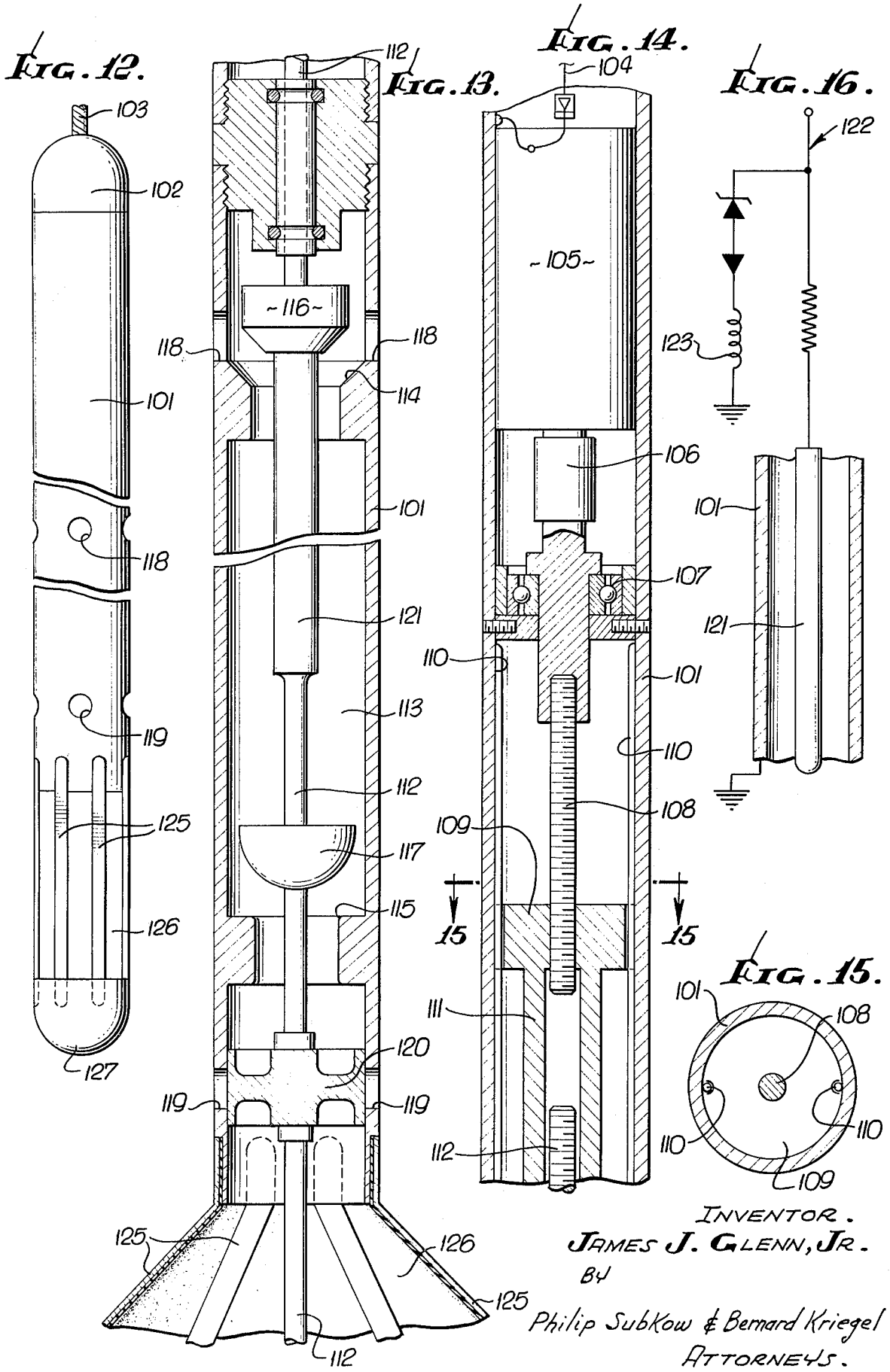
INVENTOR.
JAMES J. GLENN, JR.
BY
Philip SubKow & Bernard Kriegel
ATTORNEYS.

APPARATUS FOR THE DETERMINATION OF THE QUANTITY OF OIL

This application is a continuation in part of application Ser. No. 731,445, filed May 23, 1968 now U.S. Pat. No. 3,650,148.

This invention relates to a device and method for sampling the fluid in selected zones of an oil well which may contain a mixture of water and oil and determining the relative proportions of water and oil at such locations.

This is provided by sampling portions of the fluid at selected locations and isolating them from the rest of the fluid in the oil well and allowing stratification of the water and oil and then determining a parameter of the mixture which is a function of the composition to wit:, the ratio of the water and oil in the stratified sample. The preferred parameter is the resistance of the stratified portions of the isolated sample from which the position of the interface between water and oil in the isolated sample may be determined.

In the preferred embodiment, the fluid at the selected zone is permitted to pass into the zone of isolation, for example a sample chamber, and the isolated sample is trapped and the rest of the stream in the well is allowed to bypass the isolation chamber. The fluid in the chamber is then allowed to stratify and the position of the interface is determined, for example, by measuring the resistance of an electrode immersed in water in the sample chamber from which it may be determined where the interface between the water and oil is positioned, and therefore the relative volumes thereof.

It is an object of my invention to provide a novel method and tool which will determine the quantity of oil and water at selected locations in the well, and which will permit the determination of the relative quantities of water and oil present at the tested location.

It is a further object of my invention to provide for means to record the relative quantities of water and oil at the surface.

Another object of my invention is to isolate a sample, at a selected location of a flowing well, in a sample chamber and to allow the oil and water to stratify in said chamber and to determine the relative quantities of said water and oil in said chamber.

It is a further object of my invention to allow the fluid flow in the well to bypass the said isolated sample in the sample chamber.

It is a further object of the method and apparatus of my invention to discharge the sample from said sample chamber and to move the tool to a new location in the well where the sampling and testing of the fluid at the new location in the well may be made.

Another object of my invention is to provide a novel oil and water testing tool of the character stated which includes valves within the tool, the valves being both opened and closed to trap a sample from the fluid in the well by means of an electric motor, and the motor being started and stopped from the surface of the ground.

Other objects, advantages and features of invention may appear from the accompanying drawing, the subjoined detailed description and the appended claims.

FIGS. 1*a*, 1*b*, 1*c*, 1*d*, 1*e* and 1*f* are sequential portions of the preferred embodiment of my invention shown in section with parts in elevation.

FIG. 2 is a partial sectional view of a portion of the tool of FIG. 1 in a different status of the tool.

FIGS. 3*a* and 3*b* show partial sectional views of the zone separator portion of the FIG. 1 tool.

FIG. 12 is an elevation of another form of the tool of my invention.

FIGS. 13 and 14 are sequential sectional views of the tool with parts in elevation.

FIG. 15 is a sectional view on line 15—15 of FIG. 14.

Figure 1A:
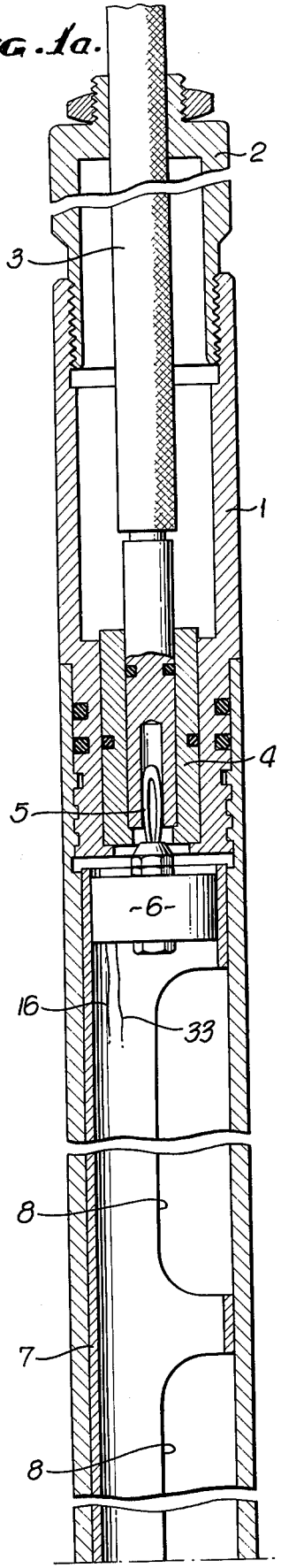

FIGS. 1*a*, 1*b*, 1*c*, 1*d*, 1*e* and 1*f* are sequential portions of the instrument shown in the position prior to the introduction into the well. The device is composed of a sectional case 1, that is screwed together as is shown in the drawings. Positioned at the top of the case is a cap 2 through which the armored cable 3 passes to be connected to the surface and to recording instruments as is conventional in down hole electrical measuring units, as will be understood by those skilled in the art. The device may be lowered into the well on the cable 3. The cable 3 which is grounded to the case 1 through its armor sheath has its live conduit connected through a banana plug 5 in a fitting 4, as is shown in FIG. 1*a* and is connected to the connector 6 as will be described more fully below.

Positioned within the case 1 and below the connector plug is a hollow tube 7 extending the length of the casing as described below, and notched in various places by windows 8. Mounted below the connector 6 is a reversible motor and reduction gear 9, connected to the tube 7, by suitable set screws as shown or by any other suitable means. The drive shaft of the motor and reduction gear, shown at 11, is connected through a universal joint to a shaft 13 on which is mounted a bracket 14 carrying reversal toggle switch 15. The toggle lever 17 is actuated by an interference in the form of a screw 18 mounted in the tube 7. The connecting terminal wires 16 pass through a bore 17 in the tube 7 and through window 8 to be connected to the connector 6.

Figure 1B:
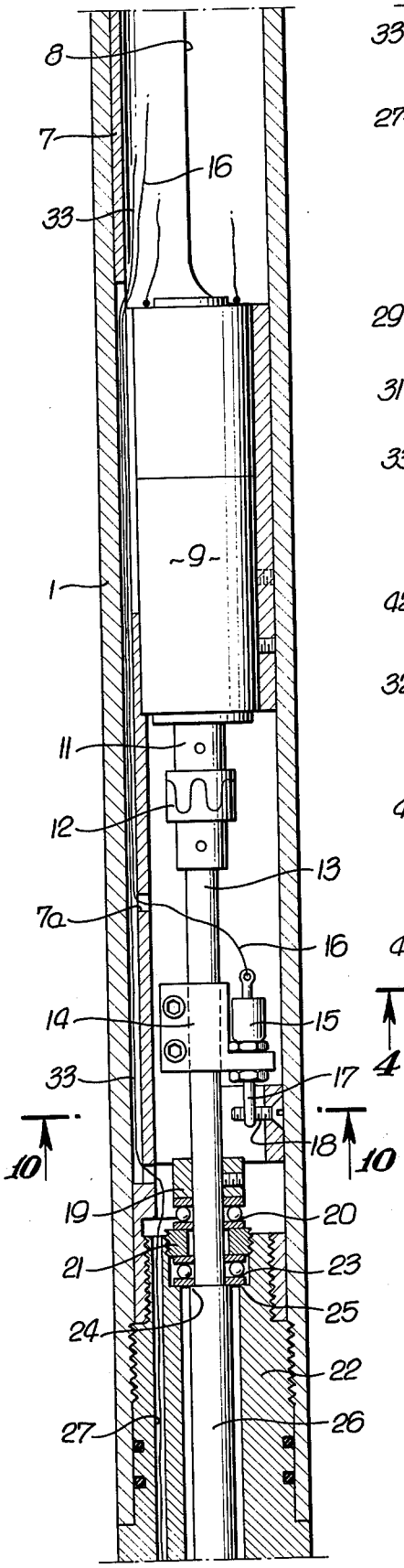
Figure 1C:
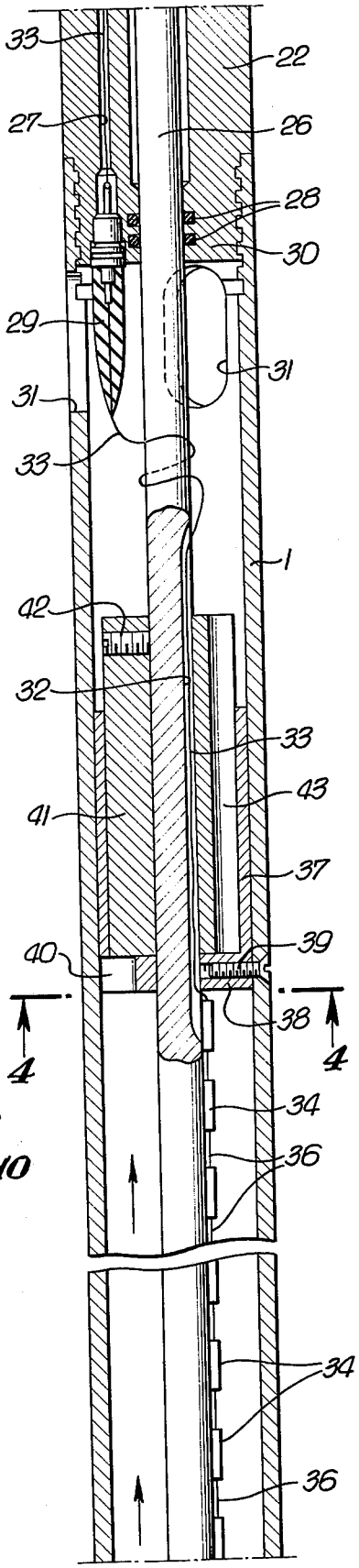

Mounted on the shaft 13 below the toggle switch is a pair of thrust bearings 20 and 23 composed of a bearing retaining collar 19 held in position by a suitable set screw and a nut 21 positioned in the tubular sleeve 22 which carries a shoulder 25. The thrust bearing 20 is positioned between the collar 19 and the nut 21 and the thrust bearing 23 positioned between the nut 21 and the shoulder 25 formed internally of the sleeve 22 and a shoulder 24 formed on the shaft 26. The case 1 is screw connected to the sleeve at 22 as is shown in FIG. 1*b*. The sleeve 22 is notched at 27 to permit the positioning of the conduit 33, see FIGS. 1*b* and 1*c*. The sleeve is bored to provide the passage of the shaft 26 suitably sealed by seal 28 (see FIG. 1*c*), thus forming a barrier wall 30 in which is positioned the insulated conduit 29 to which is connected the electrical conduit 33 which passes through the groove 27 in sleeve 22 and through the windows 8 to be connected to the connector 6 as shown in FIGS. 1*a*, 1*b* and FIG. 1*c*.

The case 1 has ports 31 positioned below the barrier 30. The rod 26 carries a valve member 41 cooperating with a tubular member 37 having a base 38 connected to the case 1 by means of the screw 39 and notched at 40. The valve member 41 is connected to the rod 26 by means of the set screw 42 and is mounted to move over the sleeve 37. The valve member 41 is notched with three grooves 43 to register with the three notches 40 as will be described below. See FIGS. 1*c*, 4, 5 and 6. The rod 26 is grooved at 32 to permit the passage of the electrical conductor 33.

Mounted on shaft 26 below the valve 41 are a plurality of closely spaced electrodes 34 insulated from the shaft and electrically connected by electrical conductors 36 insulated from the shaft 26 and connected to the connector 6 by electrical conductor 33.

Mounted below the electrodes (see FIG. 1*d*) is a valve member 44 having a top 45 and mounted on the shaft 26 by means of the set screw 47 and provided with three notches 46 (see FIGS. 1*d*, 7, 8 and FIG. 9 and with ports 48).

Positioned within the valve member 44 is a sleeve 49 having a top 51 notched with three notches 52 and provided with a port 53. The sleeve 49 is mounted in the case 1 by means of the set screw 50.

The ports 53 and 48 are designed to register with the port 54 in case 1 when the top 51 closes notch 46 and 45 closes notch 52.

The shaft 26 passes through the interior 55 of the sleeve 49. Positioned below the valve 44 is a sleeve 56 mounted in the case 1 and through which the shaft 26 extends.

Figure 1D:
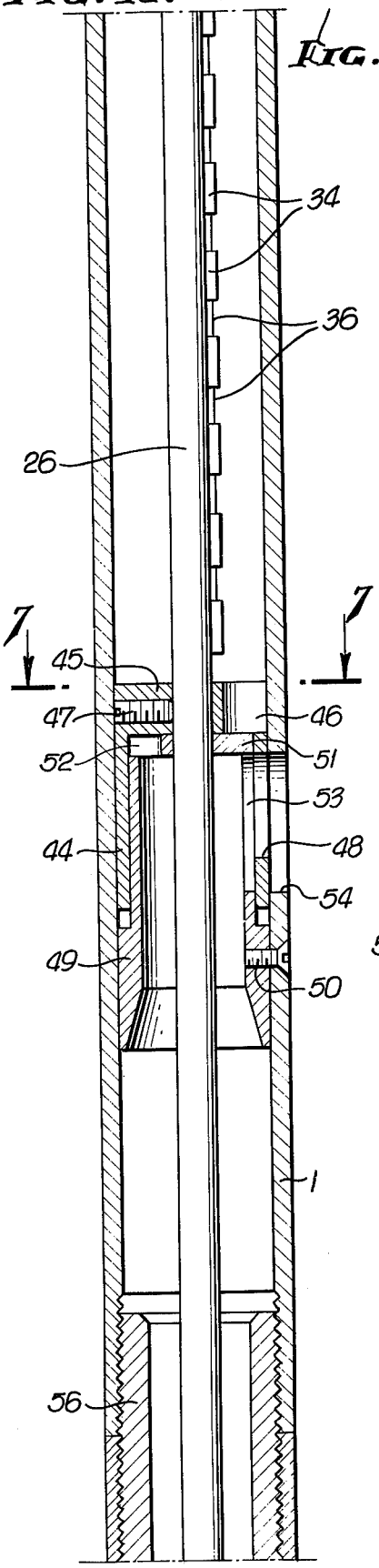
Figure 1E:
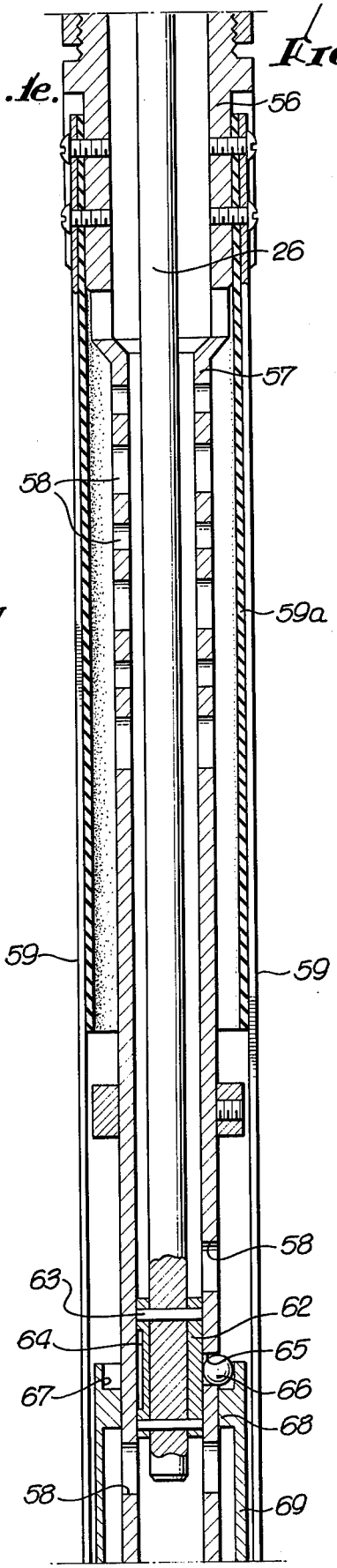

The sleeve 56 is reduced in external diameter at 57 and ported at 58 (see FIG. 1e). The shaft 26 terminates in a cam member 62 carrying a groove 64 which is in registry with a port in the tubular member 57 and in which is positioned the ball 66. The cam member 62 is connected to the shaft 26 by pin 63.

Positioned in slidable relationship with the tubular member 57 and below the end of the shaft 26 is a sleeve member 69 having an annular internal shoulder 68 at the top thereof carrying an annular groove 67 which in the position shown at FIG. 1e is in registry with the port 65 carrying the ball 66.

Figure 1F:
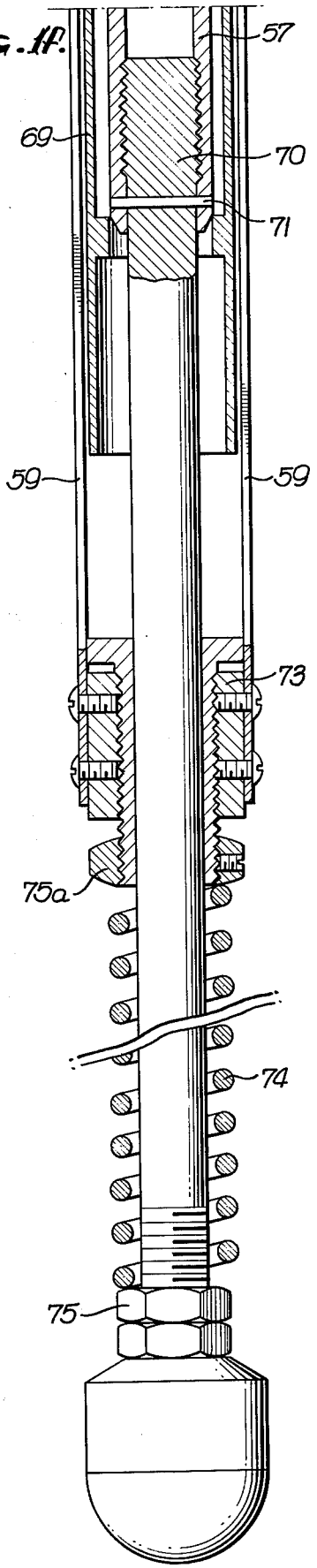

The tube 57 at the terminal end thereof is connected to a rod 70 by suitable connection shown at 71 and carries thereon a fitting 73 acting as an abutment for a terminal connection for the spring 59 which, for example, may be 8 in number and which are connected at their upper end to the sleeve 56 as it will appear in FIGS. 1*e* and 1*f*. The upper half of the spring members are interconnected by a shroud 59*a* which is oil and water tight as is conventional for fluid deflectors of this kind. As shown, a membrane such as rubber impregnated cloth is supported by the springs and makes a conduit for fluid to be described below and acts as a flow deflector and isolation member for the purpose described below.

The section terminates half way the length of the springs leaving the lower half uncovered for introduction of fluid between the springs 59 and inside the shroud 59*a*. The rod carries at its lower end a spring retaining nut 75 and a compression spring 74 positioned between the spring abutment nut 75 and the spring retaining nut 75*a*.

Figure 11:
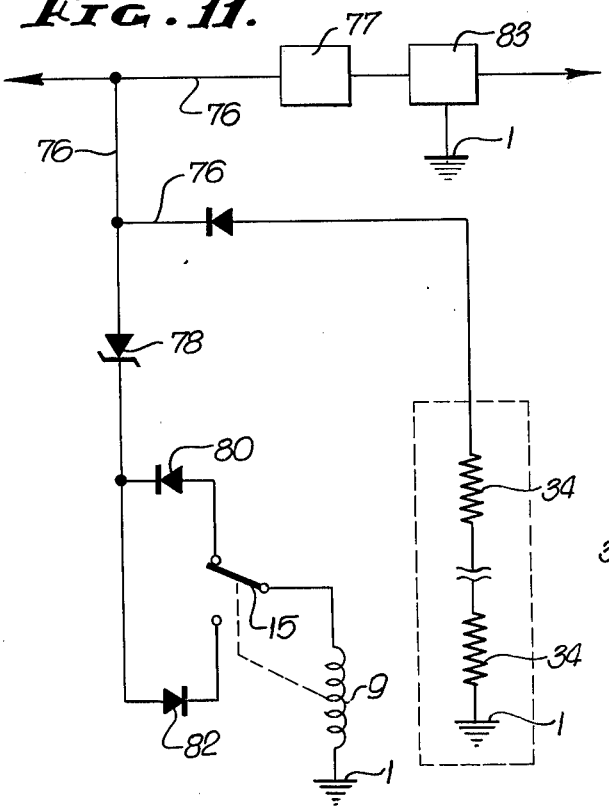
FIG. 11 is a schematic of the electrical read out circuit.
Figure 10:
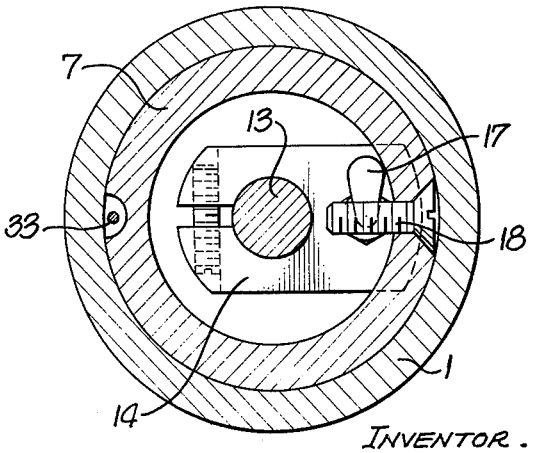
FIG. 10 is a sectional view taken on line 10—10 of FIG. 1*b*.

The electric circuitry shown in the FIG. 11 is grounded on one side by connection to the armoured cable 3 and to case 1 at the cap 2 and is carried by the insulated conduit contained in the cable 3. The connection for operation of the motor is shown in schematic form as shown in FIG. 11. The measurement circuit may be used as will be understood by those skilled in the art. The live line 76 in cable 3 is connected to a variable voltage constant current source 77 through a Zener diode 78 to the polarity reversing switch 15 via the oppositely poled diodes 80 and 82 to the motor 9 and ground via the cable 3 and case 1. The electrodes 34 are mounted in parallel with the motor and connected to the line 76 ahead of the Zener 78.

Figure 2:
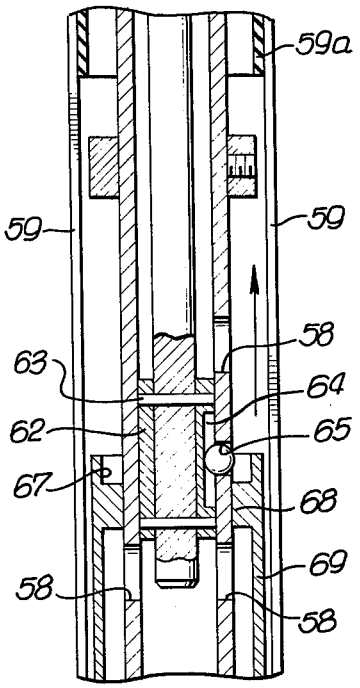
Figure 4:
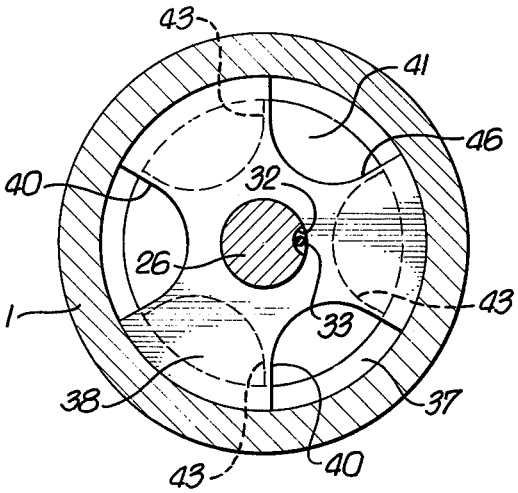
FIG. 4 is a sectional view on line 4—4 of FIG. 1*c*.
Figure 5:
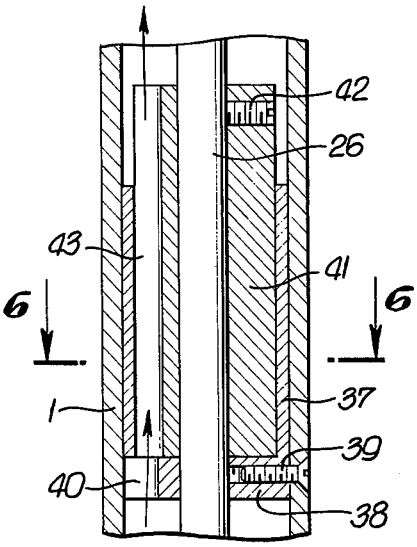
FIG. 5 is a partial sectional view of one of the valves in one status of the valve.
Figure 6:
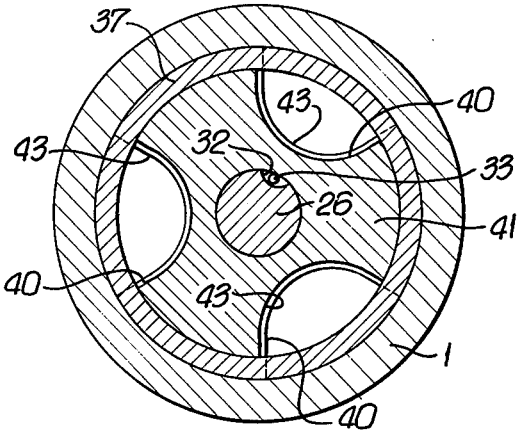
FIG. 6 is a sectional view on line 6—6 of FIG. 5.

The unit in position as shown prior to being lowered into the hole is as shown in FIGS. 1*a* to 1*f*. This is attained by rotation of the shaft 26 to place the cam element 62 in the position shown in FIG. 2. The toggle switch being in position to permit the rotation of the shaft 26 to place the cam with the slot opposite the port 65. The rod 70 may be pulled down carrying sleeve 57 past the ball 66 which is pushed into the groove 64 (see FIG. 2).

The rotation of the shaft will also cause the toggle to have reversed the polarity of the switch 15 as shown in FIG. 11. The circuit is completed through diode 81. By applying a potential at the Zeners 78 properly poled and above the breakdown potential of the Zener to cause the Zener to become conductive, motor 9 will rotate the rod 26 and bracket 14. The toggle 17 having met the interference 18 the switch flips to open the circuit through the diode 80 and close the circuit through the diode 82. The potential is now poled in the opposite direction to be conductive through Zener 78 and the motor is rotated in the opposite direction. As the motor is rotated through the required portion of one rotation the toggle again meets the interference 18 and the switch 15 is reversed to bring the contact to close the circuit through the diode 80 and open the circuit through 82.

This arrangement permits the circuit to be placed in a condition upon each rotation of the motor and shaft, whereby upon the imposition of a properly polarized potential at the Zeners above their break down potential, the motor will rotate in the opposite direction.

The shaft 26 is thus rotated to cause the cam 62 to move to the position shown in FIG. 1e whereupon the ball 68 is in the annular groove 67 so holding the springs 59 extended against the action of spring 74.

In the position shown in FIG. 1*a*–1*f*, the valves are in a position shown in 1c and 1d and fluid circulates as the unit is lowered between the springs 59 inside the shroud 59*a* and through the ports 58 into the tubular member 57, sleeve 56 and out through the ports 53, 48 and 54 which are all in registry. Ports 46 and 52 in valve 49 and channel 43 in valve member 41 are blocked as is shown in FIGS. 1*c* and 1d so that the sample chamber 26*a* between the valves is sealed from fluid and is under atmospheric pressure. The fluid which enters between the lower portions of the spring 59 bypass the sample chamber 26a by flowing through the ports 58 through 56 around and out the ports 53, 48 and 54 as described above.

As described above a properly poled potential above the breakdown potential of the Zener 78 is applied completing the circuit through the diode 82 to the motor and to ground. The motor rotates the shaft 26 thus moving the cam 62 into the position shown in FIG.

Figure 3A:
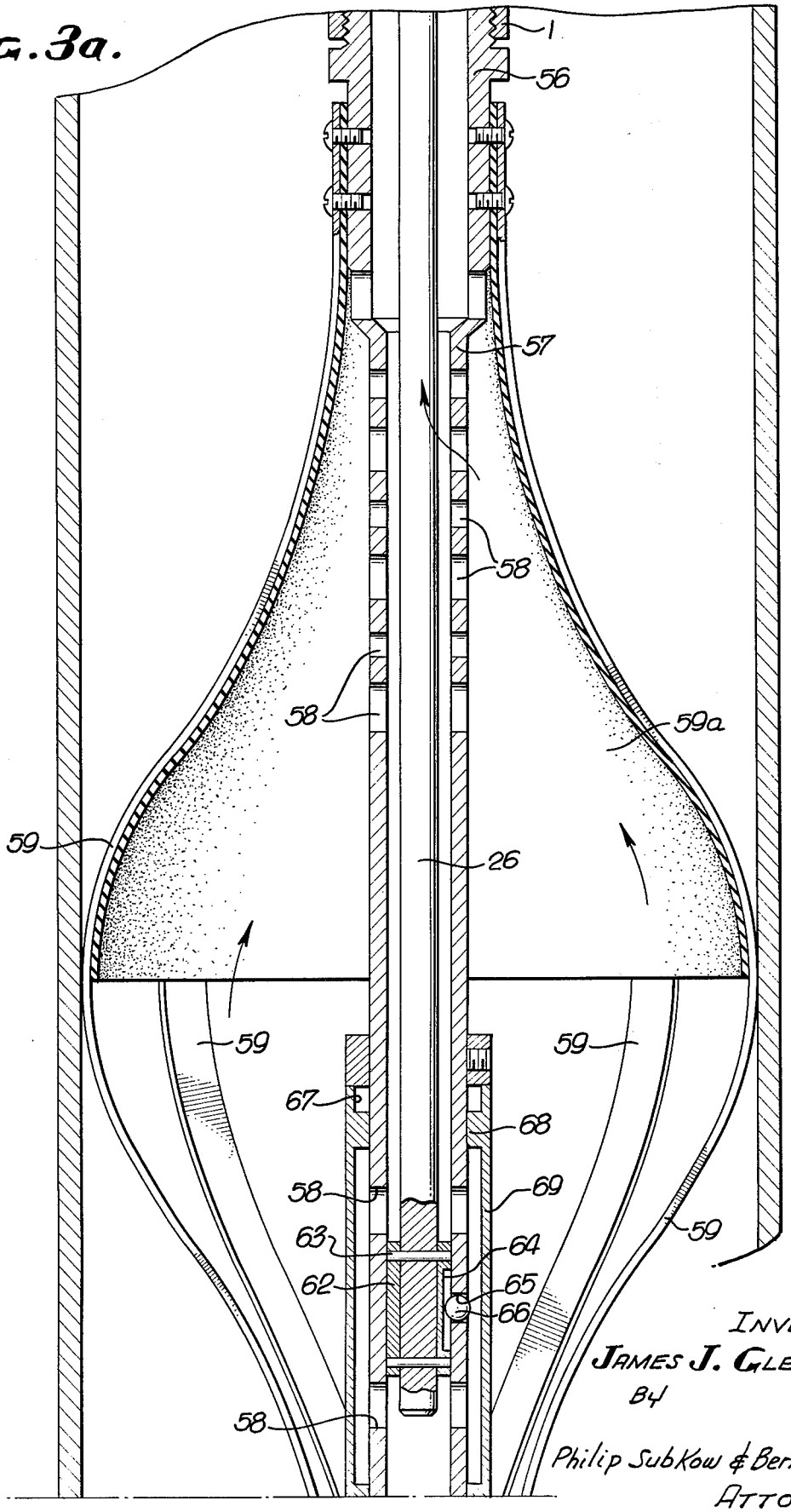
Figure 3B:
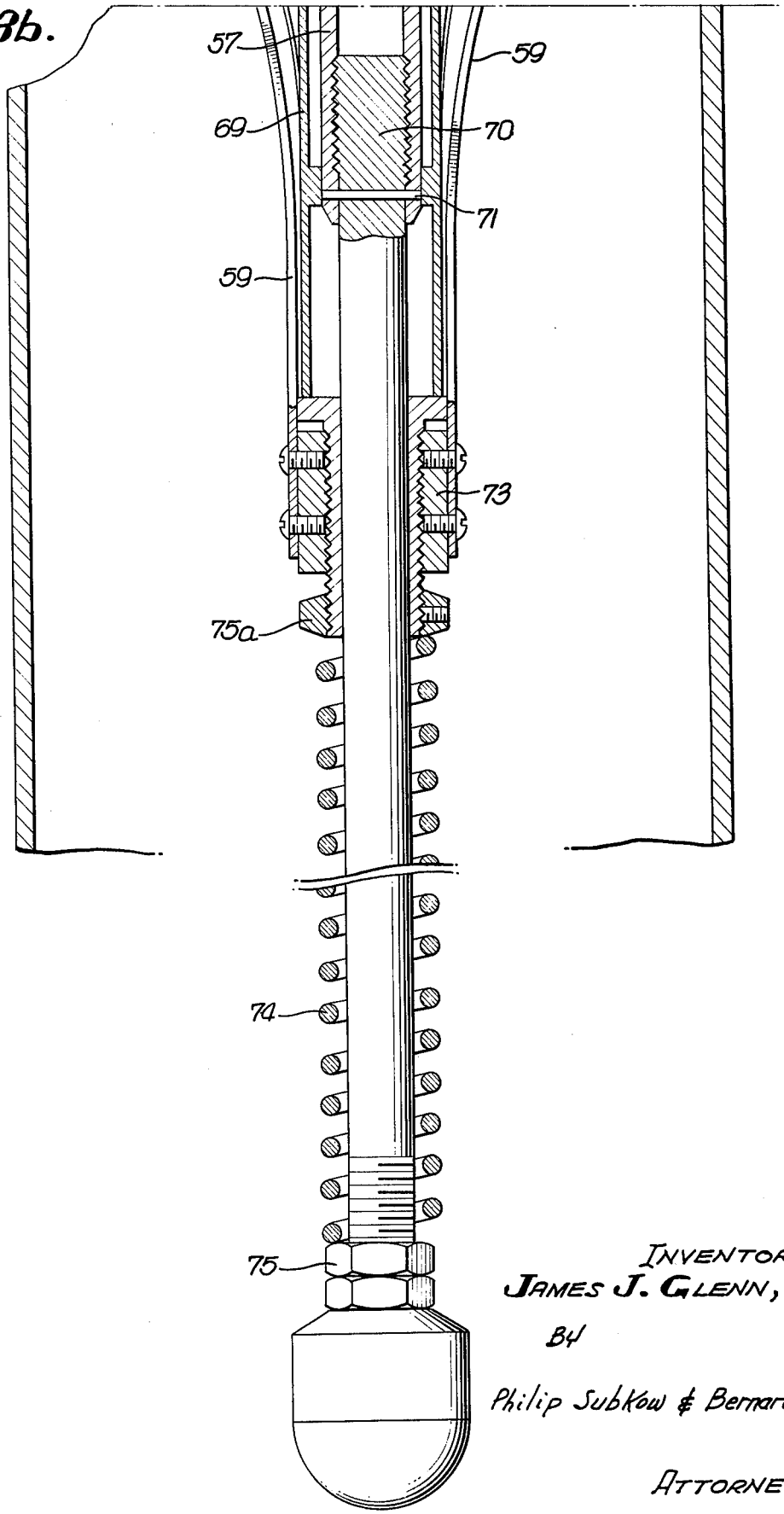
Figure 8:
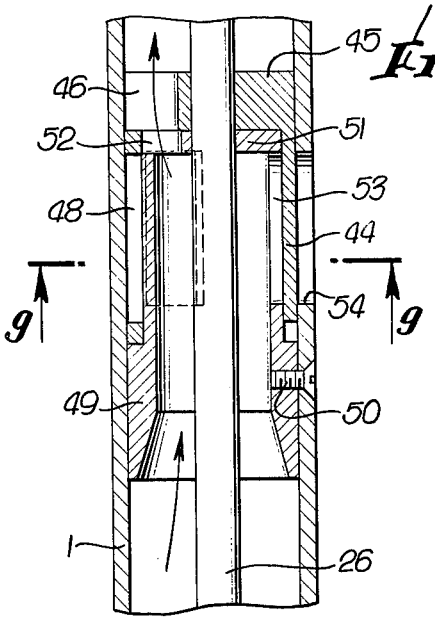
FIG. 8 is a partial sectional view of one of the valves in one status of the valve.
Figure 7:
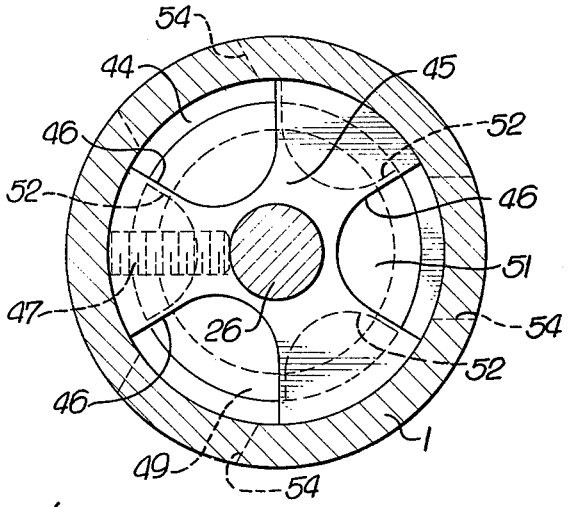
FIG. 7 is a sectional view taken on line 7—7 of FIG. 1*d*.
Figure 9:
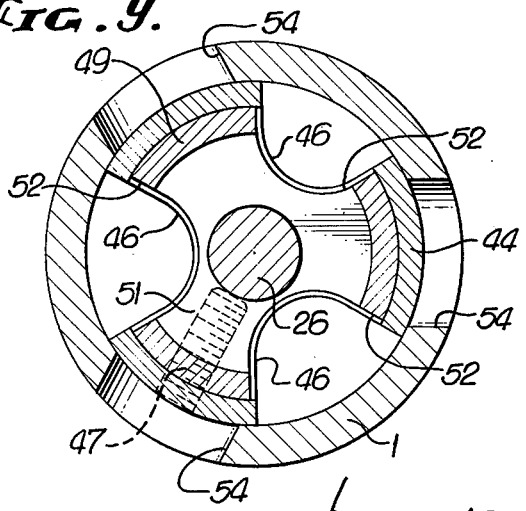
FIG. 9 is a sectional view taken on line 9—9 of FIG. 8.

2 permitting the spring 74 to pull 75 toward the stop 75*a*. The springs 59 are extended, bowing them until they contact the wall (see FIGS. 3*a* and 3*b*). The shroud acts as a barrier between the portion of the well above and the portion of the well below the shroud. The shroud thus acts as a zone isolator separating the zone in the well above and below the shroud. It acts as a fluid deflector, deflecting the fluid flow beneath the shroud through the ports 58 and upwards through the annular space about the rod 26 and finally out of the port 54 to bypass the sample chamber 26*a*.

The rod 26 is rotated to rotate the valve 49 to bring the notch 52 in registry with the notch 46 and blocking the port 48 and thus port 54. A similar situation occurs with the valve 41, the valve having been rotated until the groove 43 is in registry with the notch 40. Flow is thus permitted to pass upward from underneath the shroud 59*a* through the ports 58 up the annular space around the shaft 26 through the port 52 and 48 into the chamber 26*a*, and out through the notches 40 and the groove 43 then through the ports 31 and into the annulus of the well to the surface.

When flow has been established, the motor is reversed by proper poling of the potential at diodes 80 and 82 to move the valves into the position shown in FIGS. 1*c* and 1d thus trapping the sample in the chamber 26*a* and bypassing the flow that enters underneath the shroud and through the ports 58 and the annular chamber around 26 through the port 53, 48 and 54 which are now in registry to bypass the chamber 26*a*.

A suitable time is allowed for the oil and water to stratify in the chamber 26*a* and to establish a stable interface between the oil and water. The voltage is adjusted to below the breakdown potential at the Zeners and thus deactivating the motor and establishing a potential at the electrodes 34 and the resistance drop between the electrodes 34 and case 1 which is measured through suitable instruments 83 at the surface. As will be seen, the number of electrodes which are in the circuit will depend upon the level of the water in the chamber since the oil can be considered to be practically an insulator. The resistance of the series of electrodes 34 in the circuit may be considered to be only that of the electrodes immersed in the oil. The water being saline and thus highly conductive will short circuit the electrodes immersed in the water. The magnitude of this resistance depends on the number of electrodes immersed in the oil. Thus by measuring the total resistance of the circuit, the resistance of the circuit in series with the electrodes being known, the water completing the circuit, the number of electrodes immersed in the oil and therefore the respective height of the oil and water columns may be known.

When the in situ test described above has been completed, the tool is moved to a new location in the well. The resilience of the springs permit the movement of the tool and shroud over the wall of the bore hole to the new location. The motor is then actuated to again position the valves in the state shown in FIGS. 5, 6, 8 and 9 and flow is thus established under well fluid pressure under the shroud 59, ports 58, 46 and 43 thus discharging the fluid in the chamber through the port 31. The motor is then actuated as described above to close port 40 and 46 thus trapping a new sample in the chamber. This sample is then tested in situ as previously described.

While I presently prefer the embodiment of my invention described above, the following is also a useful form of my invention. This form is like the previously described form except for a difference in the form of the valves and the drive connection between the reversible motor and the valves and the bypass means.

Referring more particularly to the drawing, the numeral 101 indicates the outer cylindrical and tubular housing. This housing is provided with a suitable cable socket 102 at its upper end which is usual and well known in the art for oil well tools. A cable 103 is attached to the socket 102 and extends to the surface. Electrical leads 104 extend through the cable and are controlled by the operator. The cable 103 also acts as a means to support or move the tool in the bore of the well. Usual hoisting equipment (not shown) accomplishes this purpose. An electric motor 105 is mounted within the housing 101 and adjacent the upper end thereof, and the power is supplied to the motor 105 through the electric lead 104. The operator at the surface can thus start and stop the electric motor 105 at will, for a purpose to be subsequently described. The motor 105 is fixedly positioned within the housing 101 and is provided with a drive shaft 106 which is journaled in the bearing 107. The bearing 107 is fixedly mounted within the housing 101 in any suitable manner so that it will effectively support the shaft 106. A threaded shaft 108 extends downwardly from the drive shaft 106 and this shaft is threaded into a nut 109 which is mounted for vertical movement in the housing 101 but is prevented from rotating by engagement with the vertical ribs 110. An operating tube 111 extends downwardly from the nut 109 and may be an integral part of this nut. This tube will move vertically within the housing 101 with the nut 109 as the threaded shaft 108 is rotated, as will be evident.

A rod 112 is coupled or attached to the tube 111 in any suitable manner and, consequently, will move vertically with the tube. As thus far described, when the motor 105 is actuated the threaded shaft 108 will rotate in one direction or the other, depending upon the direction of rotation of the motor 105. The motor 105 being reversible, can be controlled as required by the operator at the surface. Consequently, the nut 109 and the tube 111, together with the rod 112 can be raised or lowered within the housing 101.

A testing chamber 113 is provided within the housing 101 and this chamber will have considerable length so that a substantial quantity of fluid can be entrapped in this chamber, as will be subsequently described. A valve seat 114 is provided at the upper end of the chamber 113, and a second valve seat 115 is provided at the lower end of the chamber. A valve 116 is fixedly secured to the rod 112 and will rest on the seat 114 in one position of the parts and can be lifted off of this seat to the position shown in FIG. 13. A second valve 117 is also fixedly attached to the rod 112 and moves relative to the seat 115, that is, it will be lifted off of the seat as shown in FIG. 13 in one position of the parts. The housing 101 is provided with fluid intake ports 118 which are positioned above the seat 114 and permit entrance of fluid past the seat 114 and into the chamber 113 when the valve 116 is raised. A second set of ports 119 in the housing 101 are positioned below the seat 115. These latter ports are opened or closed by means of a tubular sleeve valve 120 which is attached to the rod 112. When the valves 116 and 117 are seated, the sleeve valve 120 is moved downwardly to open the ports 119. As shown in FIG. 13 when the valves 116–117 are unseated the valve 120 closes the ports 119. When the ports 119 are closed the chamber 113 will fill with fluid and will be subsequently tested.

An electrode tube 121 is attached to the rod 112 and extends substantially the entire length of the chamber 113 and vertically within that chamber as shown. An electrical wire 122 extends from the electrode tube 121 to the surface through suitable electronic elements 123 which are usual and well known in the art. In other words, the electrode tube 121 will determine electrical resistance of the fluid in the chamber 113 and this electrical resistance will vary, depending on the amount of oil and water within the chamber.

A fluid deflector and tool stabilizer 124 consists of a plurality of spring fingers 125 which are attached to the lower end of the housing 111. These fingers engage the bore of the well and will deflect fluid outwardly as the tool is raised and also will tend to centralize and stabilize the tool. A suitable type of webbing 126 extends between the fingers 125 and is formed of either a metallic or nonmetallic material, as desired. A cap 127 is secured to the lower end of the rod 112 and this cap fits over the lower end of the fingers 125 to hold the deflector 124 in collapsed position when the tool is being lowered into the well. When bottom is reached the rod 112 together with the cap 127 is pushed downwardly by the motor 105 in the manner previously described, thus releasing the fingers 125 which spring outwardly to their extended position and remain in this position during the time that the tool is being raised to the surface.

The housing 101, with the other elements therein, is lowered in the oil well entirely to the bottom or approximately to the bottom. While the tool is being lowered the fluid deflector 124 is in the closed position, as shown in FIG. 12, and the valves 116–117 are seated. The sleeve valve 120 is in the open position, that is, the port 119 is open. When bottom is reached the motor 105 is actuated to unseat the valves 116–117 and simultaneously the sleeve valve 120 will close the port 119. The chamber 113 can now fill with fluid from the ports 118 and the tool is permitted to remain stationary in a vertical position for a length of time, permitting the water to settle to the bottom of the chamber 113 and the oil to float on top of this quantity of water. The electrode tube 121 extends into the separated water in the chamber 113 and extends through the demarcation line or surface between the oil and water. The resistance to the flow of electricity through the electrode tube 121 is read at the surface, and this will indicate the amount of water in the bottom of the chamber 113. In other words, this indicates the water "cut" in the oil. After a reading has been taken the motor 105 is reversed in direction and the valves 116–117 are lifted off of their seats, permitting the fluid in the chamber 113 to flow out through the ports 119. The rod 112 during this motor operation is moved downwardly, which pushes the cap 127 downwardly releasing the fingers 125 and permitting the tool stablizer 124 to spring outwardly acting as a fluid deflector and as a stablizer. The tool is now raised to the next desired position, after which the motor 105 is again actuated to close the valves 116–117, again trapping a sample of fluid (oil and water) in the chamber 113, and after separation of the fluids has been accomplished a second reading is taken as before, and this operation is repeated as many times as required throughout the depth of the well.

When the body member 101 is lowered into the well, the valve members 116 and 117 are seated and the fluid deflector 124 is in closed position (see FIG. 12). The sleeve valve 120 is down below the port 119 which is in open position. Port 118 is open. On reaching the bottom, the motor 105 is actuated to raise the rod 112. This opens the ports 114 and 115 to the port 118. Before reaching the extreme upward position of the rod 121, the sleeve 120 will traverse the port 119 during which period communication is established between 118, sample chamber 113 and port 119, permitting any fluid to circulate through the sample chamber between port 118 and port 119. This permits a circulation of fluid through the sample chamber during this stage of the movement of the rod 121.

When the upward limit of the travel of the rod 121 is obtained, the valve 120 closes ports 119 and fluid which has entered through 118 has filled the sample chamber. The rod now moves down closing ports 114 and 115 and opening port 119. When the valves 116 and 117 are seated, port 119 is open and sample fills are trapped in 113. When the valves close the sample chamber, fluid entry into the sample chamber is shut off and circulation in the well from the formation is bypassed around the body 101.

The fluid which fills the sample chamber 113 and has been trapped in the sample chamber 113 is permitted to settle and separate. The electrode 121 and the attendant electrical system will record the resistance of the unit, which in the case of water and oil, will be dependent entirely upon the length of the electrode which is in the oil. The water, being highly conductive, will short the portion of the electrode which is not in the oil. The resistance of the electrical system including electrode 121 is thus dependent upon the height of the oil in the system, and this permits a record of the oil in the chamber, from which the relative volumes of oil and water can be ascertained.

In order to sample the fluid in the well at various positions, isolation of the sampled zone from other portions of the well is desirable at all positions so that the true sample can be obtained at that position. To accomplish this objective the zone isolator 126 acts to separate an upper portion from a lower portion of an oil well so that a section of the well to one side of the separating means is sampled.

Obviously, any flow from the formation of the well which has not entered into the test chamber has bypassed the chamber simultaneously with the introduction of the fluid into the sample chamber.

Instead of the specific form of zone isolator referred to above (see FIG. 3a and FIGS. 12 and 13) I may employ any other equivalent zone isolator such as an inflatable packer well known in this art for isolating zones in an oil well.

I claim:

1. An oil well tool for determining the proportions of water and oil in an oil well, comprising: a sample chamber having inlet and outlet ports; means for trapping a sample of the liquid in the oil well in the sample chamber, said means for trapping said sample of liquid including rotary inlet and outlet valves operatively connected with the inlet and outlet ports of said sample chamber and a port in said tool means for directing the flow of liquid in said well through the inlet valve, sample chamber and outlet valve and out to the exterior of the tool; means in said tool connected with said valves to rotate said valves to close said valves simultaneously to trap a sample in said chamber and means to open said valves simultaneously to open a port to direct the flow to bypass said sample chamber, and means at the surface for determining in situ the relative proportions of oil and water in said trapped sample.

2. The tool of claim 1 including means for passing the fluid in said well about said tool containing said trapped sample.

3. The tool of claim 1 including means to discharge said sample from said tool into the well and means for moving said tool to a new location.

4. A tool to determine the quantity of oil in the bore of an oil well, comprising an elongated tubular housing, said housing having a cylindrical chamber therein, rotary valve means at each of the upper and the lower ends of the chamber, motor drive means within the housing and operatively connected to both of said valve means to open and close said valve means, means remotely spaced from the motor means to control the operation of said motor means, electrode in said chamber extending lengthwise thereof, and an electrical circuit including the electrode and extending to a remotely spaced resistance recording means.

5. A tool to determine the quantity of oil in the bore of an oil well as recited in claim 4 and ports in said housing and means to bypass fluid through said port on closure of said valves.

* * * * *